US010600342B2

(12) United States Patent
Parker

(10) Patent No.: US 10,600,342 B2
(45) Date of Patent: Mar. 24, 2020

(54) FORCE-ORIENTING DISPLAY SYSTEM

(71) Applicant: Douglas Parker, Henderson, NV (US)

(72) Inventor: Douglas Parker, Henderson, NV (US)

( * ) Notice: Subject to any disclaimer, the term of this patent is extended or adjusted under 35 U.S.C. 154(b) by 0 days.

(21) Appl. No.: 16/151,189

(22) Filed: Oct. 3, 2018

(65) Prior Publication Data

US 2019/0066547 A1 Feb. 28, 2019

Related U.S. Application Data

(63) Continuation-in-part of application No. 14/568,128, filed on Dec. 12, 2014, now abandoned.

(51) Int. Cl.
*G09F 11/02* (2006.01)
*G09F 13/22* (2006.01)

(52) U.S. Cl.
CPC ..... *G09F 11/025* (2013.01); *G09F 2013/222* (2013.01); *Y10T 29/4984* (2015.01)

(58) Field of Classification Search
CPC ..... G09F 11/025; G09F 2013/222; Y10T 29/4984
See application file for complete search history.

(56) References Cited

U.S. PATENT DOCUMENTS 150,364 A * 4/1874 Sherman ..... G09F 11/06 40/500
729,599 A * 6/1903 Jolly ..... G09F 11/025 116/18
865,681 A * 9/1907 Cole ..... G09F 11/02 40/473
2,798,321 A * 7/1957 Duff ..... G09F 21/046 185/30
2,828,562 A * 4/1958 Warren ..... G09F 21/046 248/201
2,850,821 A * 9/1958 Warren ..... G09F 11/02 273/143 R
3,809,785 A * 5/1974 Calabrese ..... A45D 44/005 40/503
3,819,185 A * 6/1974 Lowther ..... A63F 3/0005 273/143 E
3,861,687 A * 1/1975 Ratliff ..... A63F 5/04 273/143 E
3,919,794 A * 11/1975 Hunter, Jr. ..... G09F 11/025 40/470
4,534,567 A * 8/1985 Ferris ..... A63F 3/00075 273/143 E
5,315,776 A * 5/1994 Strawbridge ..... G09F 11/025 362/35
7,861,926 B2 * 1/2011 Sheldon ..... G06Q 20/3415 235/380
2003/0076735 A1 * 4/2003 Niland ..... B60R 13/00 366/54
2014/0352185 A1 * 12/2014 Forsline ..... G09F 11/02 40/486

* cited by examiner

*Primary Examiner* — Cassandra Davis
(74) *Attorney, Agent, or Firm* — Weide & Miller, Ltd.

(57) ABSTRACT

A force-orienting display assembly comprising a number of display segments rotatably mounted on a movable surface, the display segments positioned proximally to each other, in a manner which reassembles picture segments to display a number of properly oriented, non-inverted pictures in a plurality of viewing orientations, where the mounting surface comprises a drum or a flat vertical surface is disclosed.

13 Claims, 6 Drawing Sheets

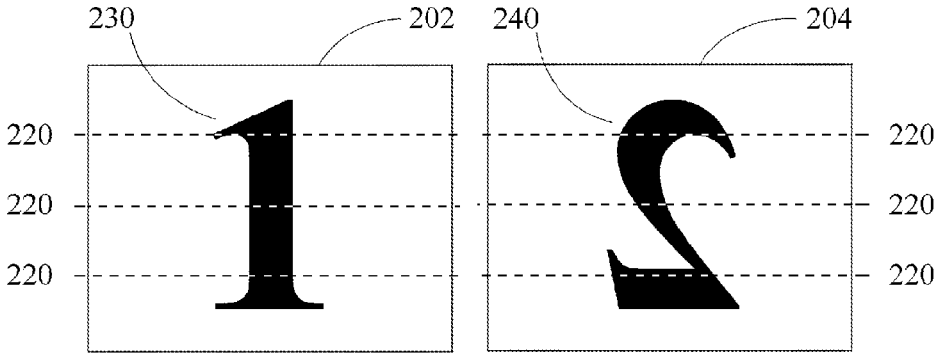
Fig. 11A
Fig. 11B
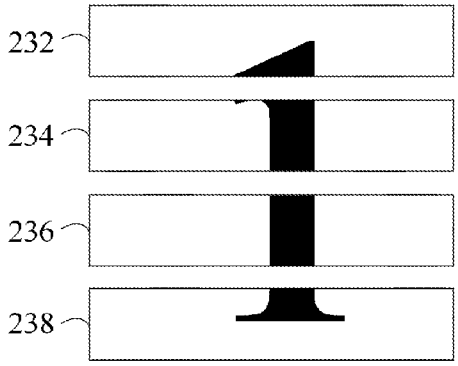
Fig. 12A
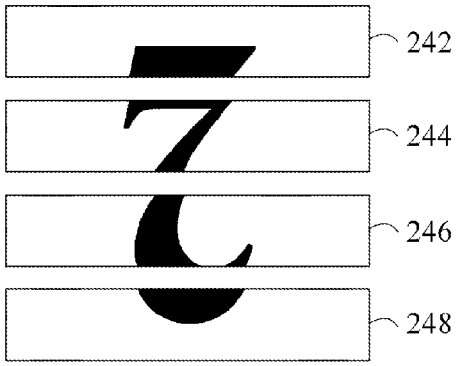
Fig. 12B
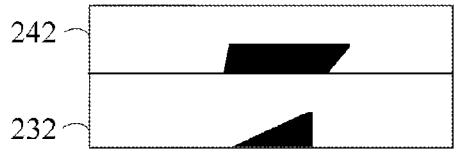
Fig. 13A
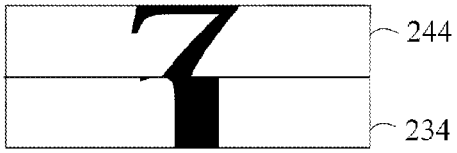
Fig. 13B
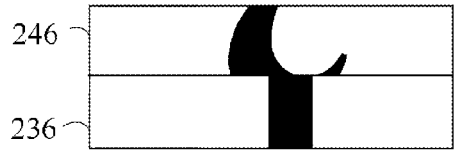
Fig. 13C
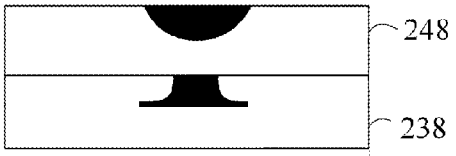
Fig. 13D

FORCE-ORIENTING DISPLAY SYSTEM

CROSS-REFERENCE TO RELATED APPLICATION

This application claims the benefit of non-provisional patent application Ser. No. 14/568,128.

BACKGROUND

The disclosed embodiments relate generally to card, picture, or sign exhibiting devices that use forces to affect a common alignment of independent rotatably mounted display elements to display one or more pictures in upright orientations.

Concrete mixer drums typically sport artwork featuring their company's logos or company names on them for marketing and advertising purposes. That artwork, physically applied to the outside of the drum, is properly displayed and oriented right-side up on one side of the mixing drum but is upside-down on the opposite side of the drum.

The inverted logo and text, repeatedly employed over the years, has always been a Pink Elephant of that industry. Some attempts to work around the restrictions on the mode of display have been to eliminate all recognizable images, trademarks, names, and any text markings from the drum's surface, opting for solid colors or simple graphic designs which have no tops or bottoms. Other approaches have been to provide text located on a circumference of the drum, providing a somewhat readable message. Text on the circumference of the drum was readable and acceptable in that it was never inverted, being readable from both sides, but was used as merely a best-case alternative as there was no way to provide for generally horizontally placed text to be displayed right-side up on both sides of the drum.

Any other placement of text on a concrete mixer drum at any orientation other than around its circumference will inevitably appear in an improper orientation, still somewhat readable, but angled and at some point in its rotation, inverted nonetheless.

A preferred solution to the inverted logo dilemma would be simple in design and simple in operation. The concrete hauling vehicles are heavy enough when empty. A solution should add minimal additional weight to the vehicle. Any solution has to be simple, lightweight, and self-sufficient.

Additionally, in an unrelated arena, point-of-purchase and point-of-sale display manufacturers are continually searching for ways to create attractive, interactive, or dynamic displays that are simple in operation and low in cost. Dynamic displays work because they attract people's attention and communicate more information in the same amount of space as a static display. If a way to create a dynamic display on a vertical surface were to be created which would be simple in construction and operation, it would provide yet another tool for the companies that are involved in the design and manufacture of displays for point-of-sale and point-of-purchase displays.

SUMMARY

Accordingly, several objects and advantages of the disclosed embodiments include, but are not limited to:

providing an easily changeable force-orienting display system which provides alignment and display of an image segmented and mounted on receiver substrates on a number of display segments through the application of existing or applied forces;

providing an easily changeable, inexpensive, dynamic advertising device for use in point-of-purchase and point-of-sale displays and others; and providing an easily changeable, segmented exhibitor display device which through the application of known or applied forces displays multiply sectioned images into their composite images through the employment of a common alignment scheme.

According to one exemplary embodiment, an easily changeable, or semi-permanent, force orienting display system is provided with a number of display segments that are positioned proximally to each other, that are attached rotatably to movable supports, and that are mounted to a moving surface. The materials used in construction of the display segments can include but are not limited to polymers, plastics, metals, or other materials which may be opaque, semi-transparent, or transparent. The weighted characteristic of each of the display segments implies that its center of balance is not colinear with the display segment's axis of rotation, guaranteeing alignment of all display segments due to the effect of gravity, or by similar argument if a force other than gravity is involved. The external surfaces of the multiple display segments have receiver substrate areas determined, and any number of images which are cut into image sections are applied to these receiver substrate areas in a variety of ways, including but not limited to painting, decals, hook and loop, slidable trays, sleeves, and other manners of attachment. As the mounting surface moves, the weighted display segments are acted on by gravity to effect a common alignment of each display segment with respect to each proximal display segment and also with respect to the mounting surface, showing common display faces on all display segments in such a manner as to display one or more pictures properly aligned top to bottom in a plurality of views. This allows for right side up orientation of logos lettering or images on, for example, two sides of a concrete mixer drum. Two images may be displayed, one on each side of the concrete mixer drum.

Further objects and advantages of the disclosed embodiments will become apparent from a consideration of the drawings and ensuing description. In the drawings, closely related figures have the same number but different alphabetic suffixes.

BRIEF DESCRIPTION OF THE DRAWINGS

FIG. 11A illustrates a sample picture used in a force-orienting display system and its cut lines.

FIG. 11B illustrates a sample picture used in a force-orienting display system as well as its cut lines. FIG. 11B is the number "2" reversed, displaying into the page and away from the reviewer.

FIGS. 12A and 12B illustrate how the pictures in FIGS. 11A and 11B are cut into picture sections for mounting. FIG. 12B is the number "2," displayed in sections and upside-down.

FIGS. 13A through 13D illustrate how the picture sections of FIGS. 12A and 12B relate to each other when applied to the mounting substrate areas defined on the display segments. The figures further illustrate a manner in which their picture sections can be recombined for attachment to display elements.

In FIGS. 15-18, when the top to bottom order is properly stacked for the correctly oriented, right side up display of image "1," the stacking order for the display of dashed, image "2" graphic reassembly appears in its reverse order on the back, unseen side of the elongated display segments. They will reverse their stacking order when a different one of the unit's plurality of views comes into alignment.

DETAILED DESCRIPTION OF EMBODIMENTS

The following terms will be used throughout the specification and will have the following meanings unless otherwise indicated.

"Picture" refers to artwork, a physical image, sign, graphic, or the like.

"Picture section" refers to a sub portion of a picture that has been cut into smaller pieces.

"Graphic section" refers to a graphic or a portion of a graphic within a picture.

"Display segment" refers to an elongated display element with defined receiver substrate areas on its exterior whose receiver substrate areas are used to mount picture sections.

The disclosed embodiments include a force-orienting display system for displaying a picture in right side up orientation in multiple viewing orientations. The display system comprises rotatable display segments mounted proximally to each other on a movable drum surface. The display segments each have receiver substrate areas established on their exteriors. Any number of pictures can be displayed where the pictures have been cut into smaller picture sections and mounted onto the receiver substrate areas. These are explained in greater detail in the following detailed description.

Figure 1:
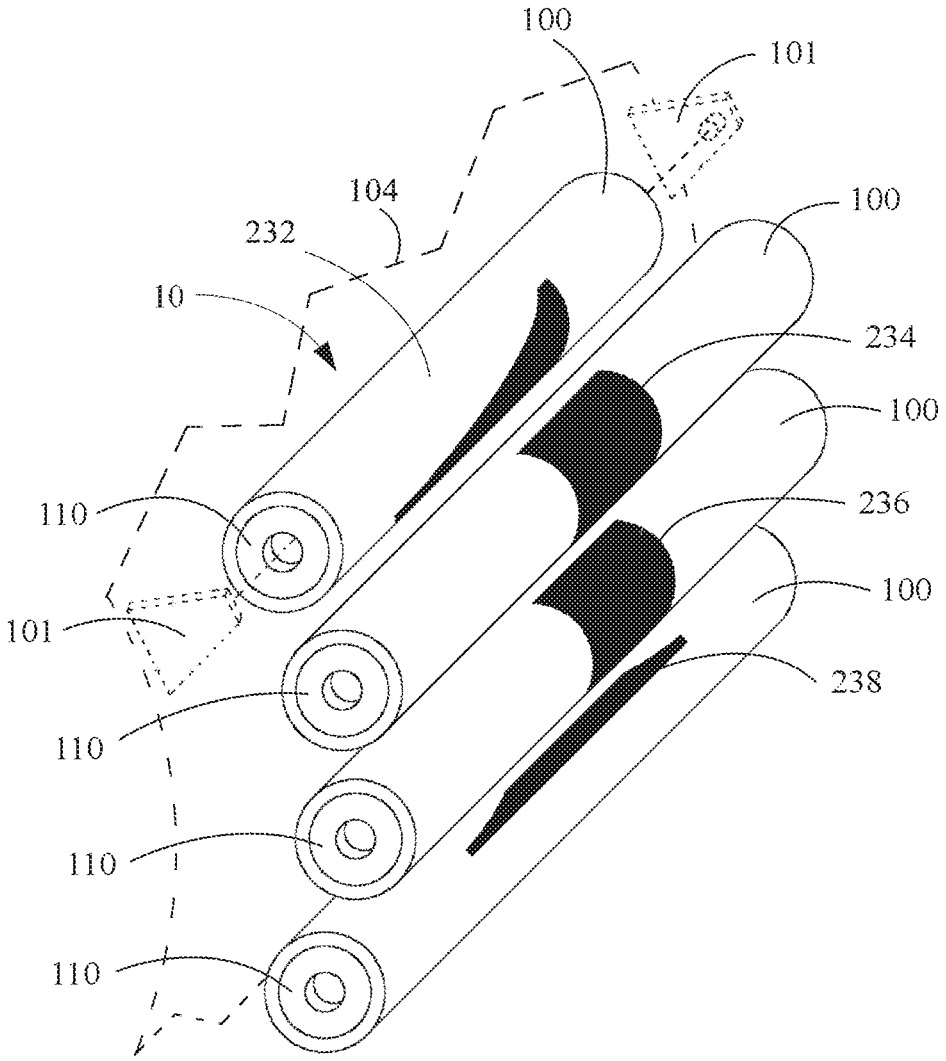
FIG. 1 shows a force-orienting display system comprising four elongated display elements of various lengths on a representative portion of a curved movable drum.

In an exemplary embodiment, a force-orienting display system 10 is illustrated in FIG. 1 showing multiple display segments 100 of any length, made from a hollow, lightweight plastic. In this embodiment, the display segments are cylinders with circular cross-sections, though any cross-section pattern allowing for free rotation of the display segments 100 can be used. The mounts 101 or display segments 100 comprise a rotational mechanism, such as a conventional bearing 110, at both ends, allowing for smooth, unobstructed rotational movement of each display segment 100 around its longitudinal axis.

The display segments 100 are attached to two conventional mounts 101 attached to a surface 104 in such a way that the display segments 100 are able to rotate freely on their longitudinal axis with respect to the surface 104. The mounted display segments 100 are proximally located to each other. Each display segment 100 has sufficient length to define areas on its exterior as a receiver substrate for picture sections to be displayed.

Figure 7:
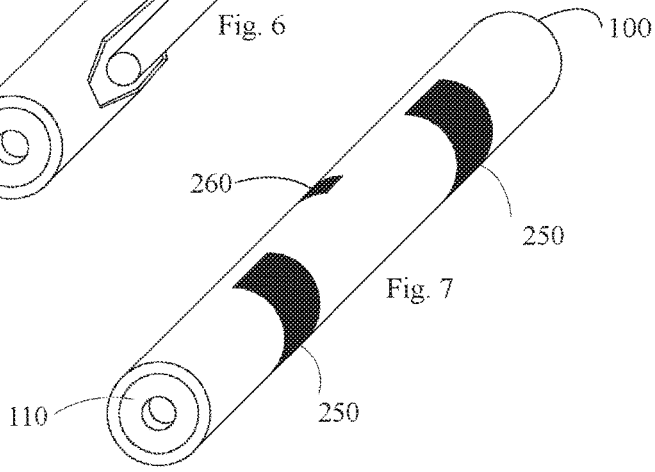
FIG. 7 shows a display element illustrating how two different graphics are mounted to a left half and a right half of a display element, providing proper orientation of the two different graphics that will later be viewed in proper orientation in a plurality of views.

FIG. 7 shows a display element illustrating how two different graphics are mounted to a left half and a right half of a display element, providing proper orientation of the two different graphics that will later be viewed in proper orientation in a plurality of views. Specifically, a right-side graphic section 250 is applied to a first side, and a left side graphic section 260 is applied to a second side.

Figure 4:
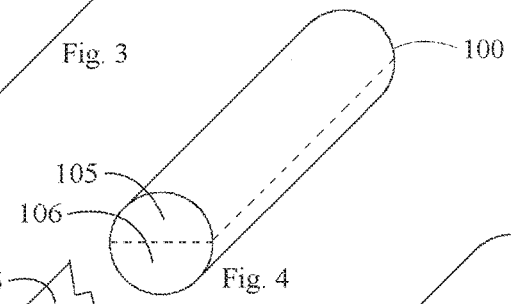
FIG. 4 shows an elongated display element illustrating a representative way that different material densities can be used to manufacture display elements that have centers of balance that are not colinear with the axis of the cylinder.
Figure 5:
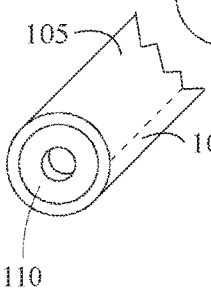
FIG. 5 shows an elongated display element whose axis of rotation is offset from the central axis of its cylinder.
Figure 5:
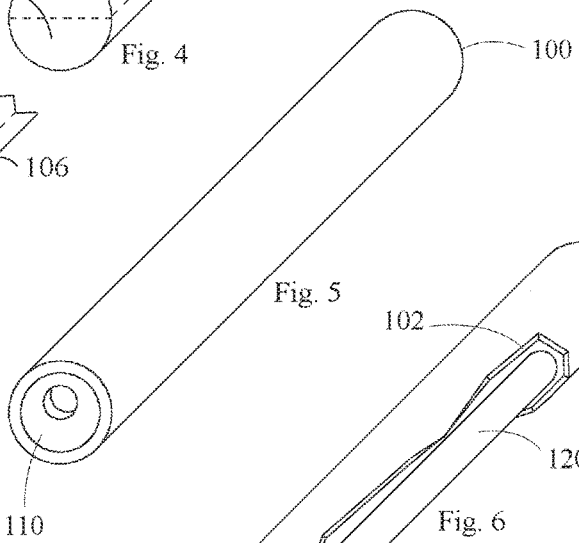
Figure 6:
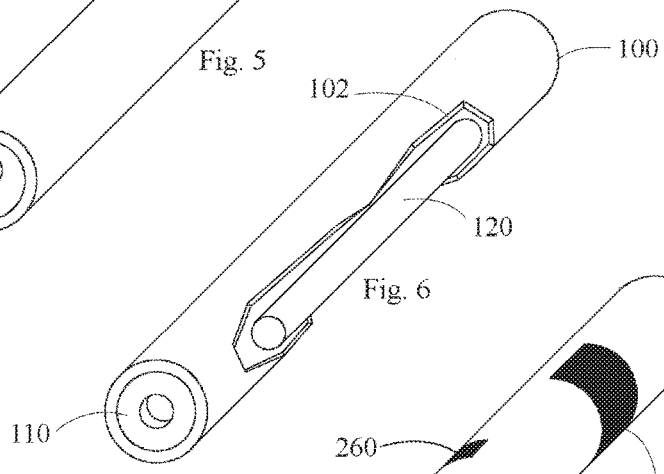
FIG. 6 shows a cutaway of an elongated display element illustrating a method of adding a force inducing mass to the inside of a display element.

The center of mass of each display segment 100 is not colinear with its axis of rotation. FIG. 6 illustrates a cutaway view 102 of a segment 100 where the center of mass of a display segment 100 is modified by adding an internal mass 120, which may be made of a ferrous metal, lead, plastic, polymer, or other type of material suitable for use as an internal weight. FIG. 4 illustrates how materials of different densities can be used to create display segments with centers of mass non-colinear with their axes of rotation. For example, in FIG. 4, material 105 may be a relatively lighter density material and material 106 may be a relatively higher density material.

Receiver substrate areas for mounting picture sections are determined by examining a display segment 100 at rest. Its orientation will have its center of balance below the axis of rotation. A plane through the axis of rotation and the resting center of balance defines a left and right receiver substrate area. Display segments 100 displaying image segments mounted on their receiver substrate areas on the display segments are shown in FIGS. 15-18.

Pictures selected and cut into smaller picture sections are calculated to fit the physical dimensions of and are attached to the right-side half and left side half receiver substrate areas defined.

Figure 9:
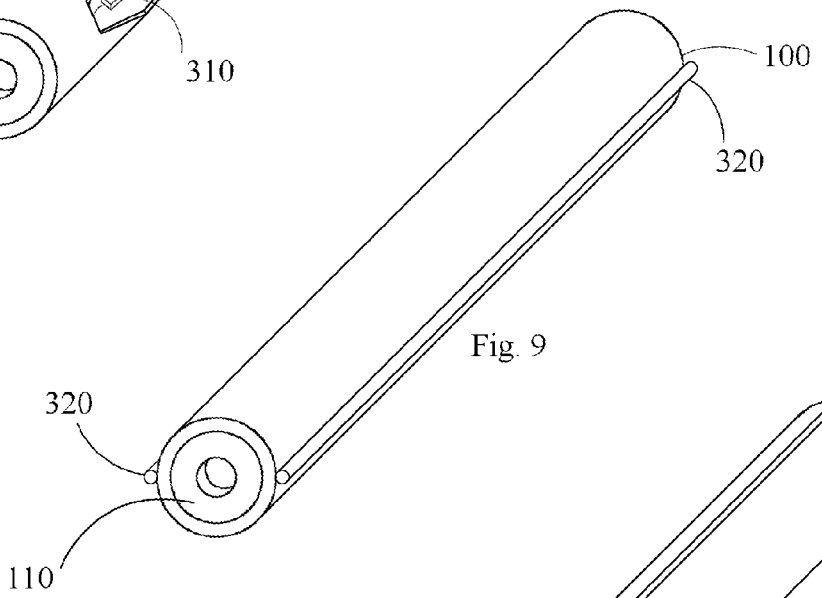
FIG. 9 illustrates an elongated display segment displaying tongues used for slidably mounting removable curved picture section sleds.
Figure 10:
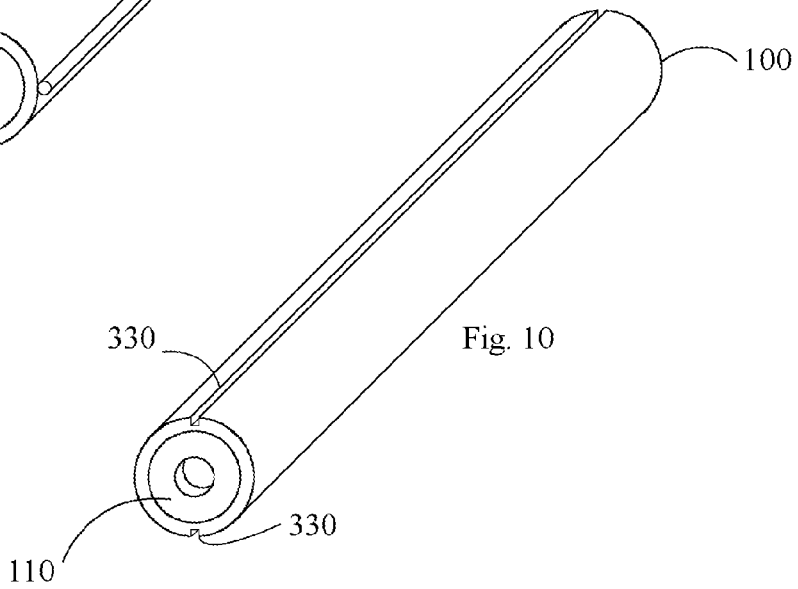
FIG. 10 illustrates an elongated display segment with channels used for slidably attaching removable curved picture section sleds.

In one embodiment, the picture sections are printed onto the surface of curved, removable display sleds with semi-circular cross sections extending the length of the display segments 100 and slidably attached to a plurality of tongues 320 as illustrated in FIG. 9 through a corresponding lengthwise groove in the sled, or slidably attached to grooves 330 as illustrated in FIG. 10 through corresponding tabs or tongue along its lengthwise edges. FIGS. 11A, 11B, 12A, and 12B show steps in the cutting of two pictures 202, 204 into picture sections 232, 234, 236, 238, 242, 244, 246, 248 by cutting along cut lines 220. FIGS. 13A through 13D illustrate combining the picture sections 232, 234, 236, 238, 242, 244, 246, 248 from FIGS. 12A and 12B into multiple single sheet units which are then applied to multiple display segments 100 in FIGS. 15-18.

Figure 14:
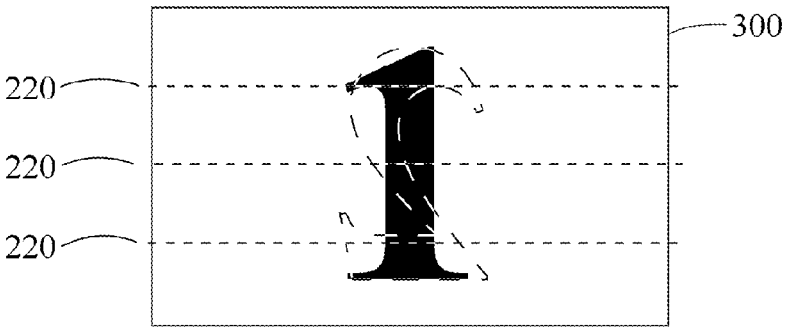
FIG. 14 shows a relative positioning of FIGS. 11A and 11B when stacked back to back.
Figure 15:
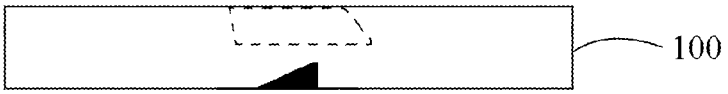
FIG. 15 illustrates picture segments of FIG. 13A applied to the substrate area of an elongated display segment. The solid black artwork is the front facing image segment of the "1" graphic, and the dashed line is the backward facing and reverse stacked image segment of the "2" graphic.
Figure 16:
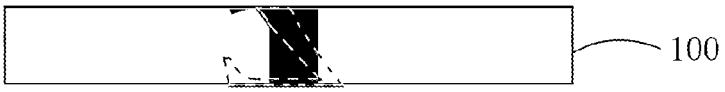
FIG. 16 illustrates picture segments of FIG. 13B applied to the substrate area of an elongated display segment. The solid black artwork is the front facing image segment of the "1" graphic, and the dashed line is the backward facing and reverse stacked image segment of the "2" graphic.
Figure 17:
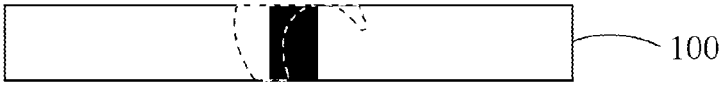
FIG. 17 illustrates picture segments of FIG. 13C applied to the substrate area of an elongated display segment. The solid black artwork is the front facing image segment of the "1" graphic, and the dashed line is the backward facing and reverse stacked image segment of the "2" graphic.
Figure 18:
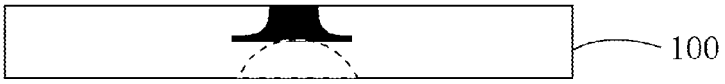
FIG. 18 illustrates picture segments of FIG. 13D applied to the substrate area of an elongated display segment. The solid black artwork is the front facing image segment of the "1" graphic, and the dashed line is the backward facing and reverse stacked image segment of the "2" graphic.

Whereas the picture sections 232, 234, 236, 238, 242, 244, 246, 248 from FIGS. 12A and 12B are used in FIGS. 13A through 13D, the picture sections from FIGS. 11A and 11B are used in FIGS. 15-18, showing the relationship of the different picture sections with respect to each other when attached to an embodiment of the disclosed display system 10. FIG. 14 shows a relative positioning 300 of FIGS. 11A and 11B when stacked back to back. Typically, one side of the force orienting display system 10 will display a picture to the viewer with its picture sections stacked in a sequentially correct order to display a picture visible to the viewer, as the "1" graphic 230 in FIGS. 15-18 show. The side facing away from the viewer will be displaying a stacking order in a reverse, inverted order. The hidden dashed lines of the "2" graphic 240 in FIGS. 15-18 illustrate this reversed stacking order.

In one embodiment, a display system 10 as illustrated in FIG. 1 comprises any number of elongated display segments 100 rotationally mounted to the outside surface 104 of a moving surface such as a drum and is acted on by a known force such as gravity. Each elongated display segment 100, having a receiver substrate area defined, will have picture sections attached to the substrate areas. The display segments 100 are positioned generally parallel to the surface's 400 axis of rotation. A number of elongated display segments 100 mounted sufficiently close to each other allow free rotation of all elongated display segments 100 around the surface 104 such as a drum. As the drum completes its full rotations, e.g. as the drum rotates through 360°, the force acting on the elongated display segments 100 will align all of the display segments in similar orientations to a viewer with respect to the surface 104 (e.g. a surface of the drum) displaying a number of reconstructed pictures right side up on one side of the drum, and displaying a number of reconstructed pictures right side up on the opposite side of the drum, thus providing proper orientation for viewing in a plurality of orientations.

Figure 2:
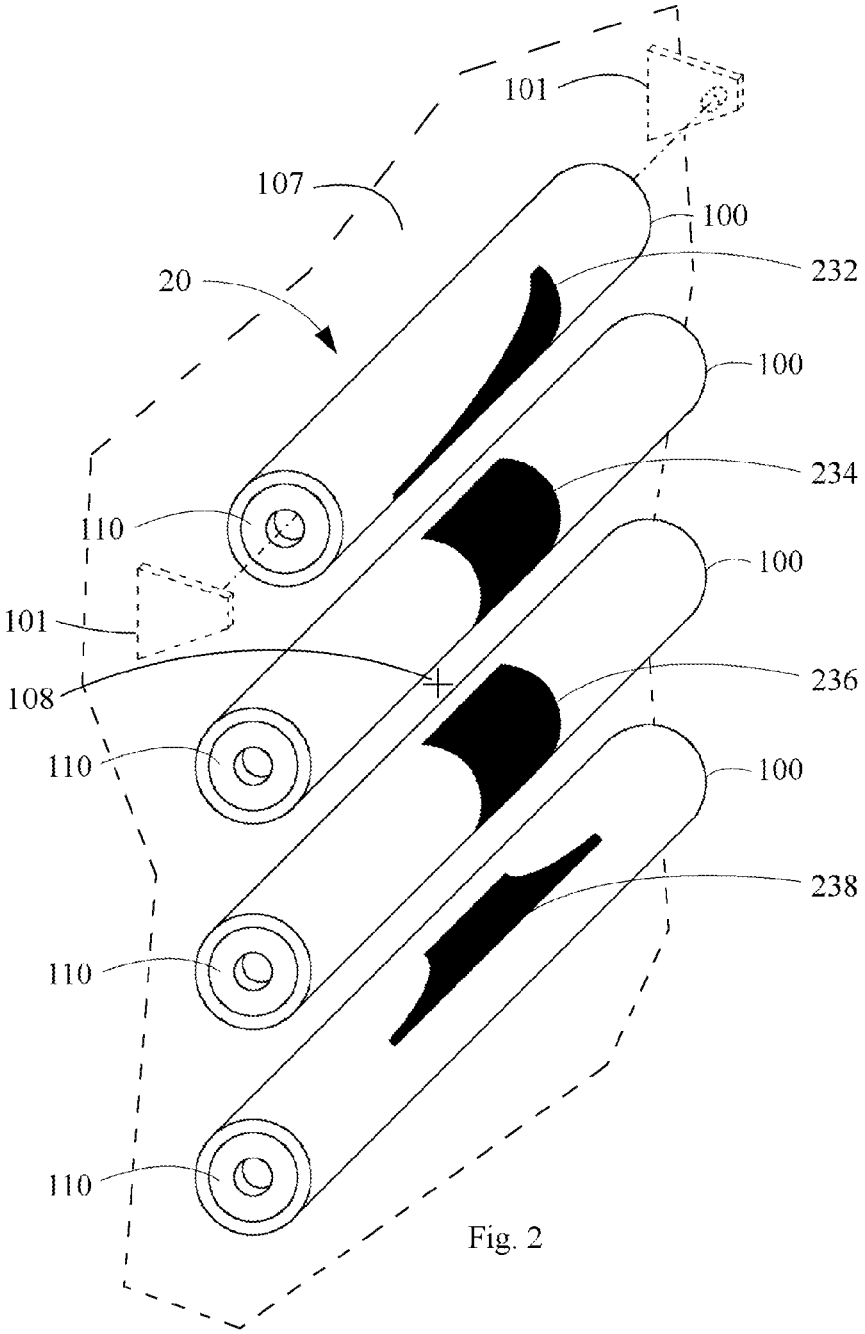
FIG. 2 shows a force-orienting display system comprising four elongated display elements of various lengths on a representative portion of a movable planar surface, with its vertical center of rotation as marked.
Figure 3:
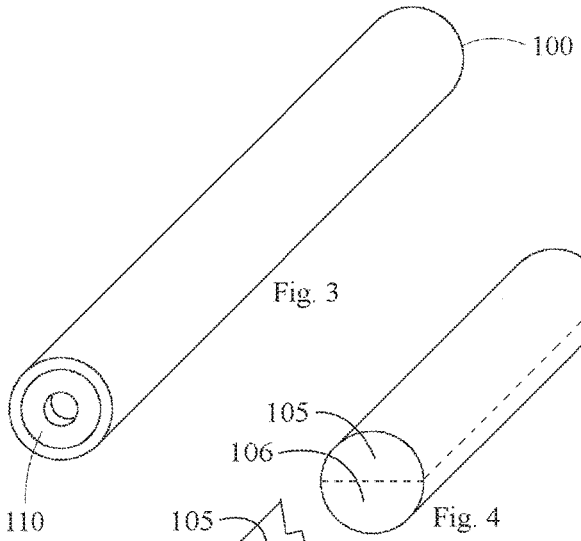
FIG. 3 shows an elongated display element whose axis of rotation is colinear with the center of the cylinder's axis.

Referring to FIG. 2, another embodiment of a display system 20 is shown by mounting one or more display segments 100 on an essentially flat, generally vertical, rotating surface 107, such as a display in a store. Picture sections 232, 234, 236, 238 on receiver substrate locations on each of the elongated display segments are reassembled to display a picture.

As the rotating, generally vertical surface is rotated 180°, the picture displayed will change from displaying the picture on its "1" right side to displaying the picture on its "2" left side. As the rotating, generally vertical surface is rotated through another 180°, the picture displayed will alternate from displaying the picture on its "2" left side to displaying the picture on its "1" right side. The picture displaying cycle then repeats.

Of course, the display system 20 described above may be implemented on non-flat surfaces.

Still another embodiment incorporates the application of one or more known different forces to act on the display segments, such as magnetism, acting on an internal, ferrous mass, which is used simultaneously as a mass to alter its overall center of mass.

In another embodiment, the number of receiver substrate may be more than two, such as defining four receiver substrate locations around the display segments 100 instead of two. Gravity and magnetism could then be used in conjunction to display one of four images.

An alternate embodiment for affecting the center of mass of the display segments 100 is noted by designing a portion of the display segment 100 to comprise materials of differing densities, such as a relatively light density material 105 and a relatively low density material 106 as shown in FIG. 4, thus making one portion of the display segment 100 heavier or lighter than the other. Alternately, hollow display segments 100 can be extruded to have differing wall thicknesses around its circumference yet consistent along its length, giving that portion of the display segment 100 with its thicker walls more mass.

The placement of the rotational mechanism 110 may be varied in some embodiments. For example, the rotational mechanism 110 may be integral to the display segment 100, or it may be integral to its mount 101.

In some embodiments, the display segments 100 may have different diameters. In another exemplary embodiment, transparent tubing is slid over the display segments 100 to attach, secure, and retain the picture sections to the display segments 100.

Figure 8:
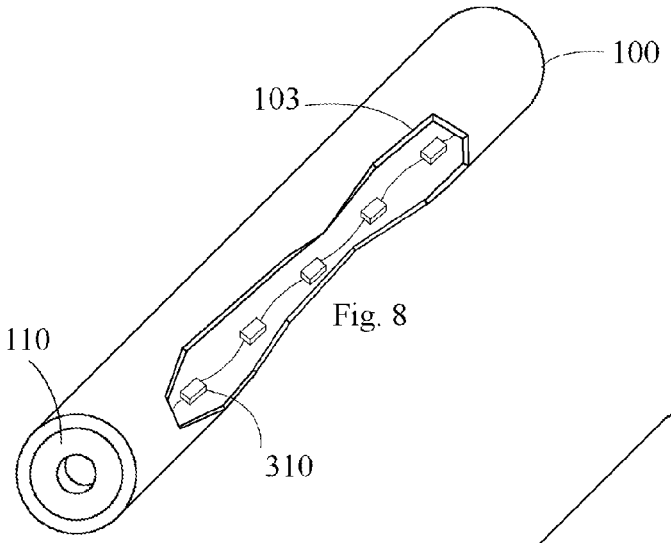
FIG. 8 shows a cutaway view of an elongated display segment with internal lighting devices for internal illumination.

In another exemplary embodiment, mounts which conduct electricity or incorporate electrical conductors for conducting electricity may be provided for light generating elements 310, such as a light emitting diode as shown within the cutaway section 103 in FIG. 8, or for powering any subsequent internal devices.

In some embodiments, picture sections can be removably secured to by any appropriate attachment expedient, such as magnetic backed picture sections and a magnetically attractive surface, by the use of hook and loop material on the backs of the picture sections and on the receiver substrate areas.

An alternate embodiment for attaching the graphic sections is evident in that some picture sections will bear a convenient adhesive layer on their obverse, protected by a strippable liner, where the liner can be pulled away from the picture section, exposing an adhesive surface.

Yet another alternate embodiment is for pictures which are painted or printed onto the receiver substrate areas.

Referring again to FIG. 2, in one embodiment of a display system, initial operation starts by providing display segments 100 on an essentially flat, generally vertical, rotating or movable surface 107, then selecting, cutting and attaching picture sections 232, 234, 236, 238 to receiver substrate areas on the display segments 100. By moving or rotating the movable surface 107 around its central rotation point 108 and stopping the rotation when the display segments 100 are essentially horizontal, different pictures are alternately displayed. The properly displayed, forward facing picture surface could be part of a point-of-purchase display, with alternating messages or images displayed to shoppers.

Explained herein is a system for displaying one or more pictures mounted on one or more independent, freely rotatable, elongated display segments which are attached proximally to each other on a movable surface. The movable surface acts to change the position and orientations of the different display segments with respect to the surface and to nearby display segments, causing a coordinated change of display between one of two different pictures in non-inverted orientations. For example, it correctly displays logos in proper top to bottom orientation on both sides of a concrete mixer drum.

A mounting surface need not be completely flat, but the display segments rotate freely with respect to the mounting surface, taking into account all possible movements of the mounting surface. Each display segment attached to a rotating surface must have free, unobstructed rotation throughout the entire range of motion of the surface.

The display segments remain generally parallel to each other. They will properly align to display pictures while their axes of rotation are synchronized left sides to left sides, and in a primarily non-vertical orientation. They are not required to be confined to horizontal orientations only, as gravity continues to act on the horizontal component of the center of mass acting on the center of rotation of the display segment to provide a rotational moment when the display segment is not in a true horizontal orientation. However, as the axes of rotation of the display segments approach a vertical orientation, the centers of mass of the display segments become more closely aligned with the axes of rotation, the rotational moment of the horizontal component of gravity on the center of mass acting along the center of rotation approaches zero, and gravity begins to have less effect in providing its novel, desired alignment force on the display segments, and the display coordination breaks down.

While the above description contains many embodiments, these should not be construed as limitations on the scope of the invention, but as exemplary implementations thereof. Many other ramifications and variations are possible within the teachings of the invention.

Thus, the scope of the invention should be determined by the appended claims and their legal equivalents, and not by the examples given.

I claim:

1. A display system comprising:

a display surface;

a plurality of independent, freely rotatable display segments attached to the display surface via mounts, each of the display segments being rotatable about an axis of rotation, and each of the display segments having a center of mass that does not intersect with the axis of rotation, the display segments comprising:

a first display segment comprising a first picture section, and a second display segment mounted adjacent to the first display segment, the second display segment comprising a second picture section, wherein the first picture section and the second picture section correspond to form at least a portion of a graphic when gravity causes the first display segment and the second display segment to rotate to align the first picture section and the second picture section, wherein the display segments are cylindrical, and the display segments are mounted horizontally on the display surface, and wherein the display segments are formed with a relatively higher density material on one side and a relatively lower density material on the other side to cause the center of mass to not intersect the axis of rotation.

2. The display system of claim 1 wherein the mounts or ends of the cylindrical segments comprise bearings.

3. The display system of claim 1, wherein the display segments comprise an internal mass to cause the center of mass to not intersect the axis of rotation.

4. The display system of claim 1, wherein the first display segment further comprises a first opposite picture section disposed on an opposite side of the first display segment from the first picture section, and the second display segment further comprises a second opposite picture section disposed on an opposite side of the second display segment from the second picture section.

5. The display system of claim 4, wherein the display surface is a rotatable drum, the first picture section and the second picture section face away from the drum when the first display segment and the second display segment are on a first side of the drum, and the first opposite picture section and the second opposite picture section face away from the drum when the first display segment and the second display segment are on a second side of the drum.

6. The display system of claim 4, wherein the display surface is a flat surface that is rotatable in a first orientation and a second orientation, the first picture section and the second picture section face away from the flat surface when flat surface is in the first orientation, and the first opposite picture section and the second opposite picture section face away from the flat surface with the flat surface is in the second orientation.

7. A display system comprising:

a display surface;

a plurality of independent, freely rotatable display segments attached to the display surface via mounts, each of the display segments being rotatable about an axis of rotation, and each of the display segments having a center of mass that does not intersect with the axis of rotation, the display segments comprising:

a first display segment comprising a first picture section, and a second display segment mounted adjacent to the first display segment, the second display segment comprising a second picture section, wherein the first picture section and the second picture section correspond to form at least a portion of a graphic when gravity causes the first display segment and the second display segment to rotate to align the first picture section and the second picture section, wherein the display segments are cylindrical, and the display segments are mounted horizontally on the display surface, and wherein the axis of rotation is not centered on the cylindrical display segments to cause the center of mass to not intersect the axis of rotation.

8. A display system comprising a first display segment being independently freely rotatable about a first axis of rotation, the first display segment having a first center of mass that does not intersect with the first axis of rotation, and the first display segment comprising a first picture section; and a second display segment disposed adjacent to the first display segment, the second display segment being independently freely rotatable about a second axis of rotation, the second display segment having a second center of mass that does not intersect with the second axis of rotation, and the second display segment comprising a second picture section wherein the first picture section and the second picture section correspond to form at least a portion of a graphic when gravity causes the first display segment and the second display segment to rotate to align the first picture section and the second picture section, wherein the first and second display segments are cylindrical, and the first and second display segments are disposed horizontally, and wherein the first and second display segments are formed with a relatively higher density material on one side and a relatively lower density material on the other side to cause the first and second center of masses to not intersect the first and second axes of rotation, respectively.

9. The display system of claim 8, wherein the first and second display segments comprise bearings.

10. The display system of claim 8, wherein the first and second display segments each comprise an internal mass to cause the first and second center of masses to not intersect the first and second axes of rotation, respectively.

11. The display system of claim 8, wherein the first display segment further comprises a first opposite picture section disposed on an opposite side of the first display segment from the first picture section, and the second display segment further comprises a second opposite picture section disposed on an opposite side of the second display segment from the second picture section.

12. The display system of claim 11, wherein the first and second display segments are mounted to a rotatable drum, the first picture section and the second picture section face away from the drum when the first display segment and the second display segment are on a first side of the drum, and the first opposite picture section and the second opposite picture section face away from the drum when the first display segment and the second display segment are on a second side of the drum.

13. The display system of claim 11, wherein the first and second display segments are mounted to a flat surface that is rotatable in a first orientation and a second orientation, the first picture section and the second picture section face away from the flat surface when flat surface is in the first orientation, and the first opposite picture section and the second opposite picture section face away from the flat surface with the flat surface is in the second orientation.

* * * * *